US009504864B2

(12) United States Patent
Cole, Jr.

(10) Patent No.: US 9,504,864 B2
(45) Date of Patent: Nov. 29, 2016

(54) CONTAINMENT APPARATUS AND METHOD OF REMOVING A FIRE SPRINKLER HEAD

(71) Applicant: Donald H. Cole, Jr., Peoria, AZ (US)

(72) Inventor: Donald H. Cole, Jr., Peoria, AZ (US)

( * ) Notice: Subject to any disclaimer, the term of this patent is extended or adjusted under 35 U.S.C. 154(b) by 715 days.

(21) Appl. No.: 13/917,372

(22) Filed: Jun. 13, 2013

(65) Prior Publication Data

US 2013/0334809 A1 Dec. 19, 2013

Related U.S. Application Data

(60) Provisional application No. 61/661,166, filed on Jun. 18, 2012.

(51) Int. Cl.

| | |
|---|---|
| ***A62C 35/68*** | (2006.01) |
| ***A62C 99/00*** | (2010.01) |
| ***B05B 15/00*** | (2006.01) |
| ***E03B 7/09*** | (2006.01) |
| *A62C 37/08* | (2006.01) |

(52) U.S. Cl.

CPC ..... *A62C 99/00* (2013.01); *A62C 35/68* (2013.01); *B05B 15/00* (2013.01); *E03B 7/09* (2013.01); *A62C 37/08* (2013.01); *Y10T 29/49815* (2015.01)

(58) Field of Classification Search

CPC ..... B05B 15/02; F16K 27/12; E03B 7/09; A62C 35/68; F16L 37/127; F16L 21/06; F16L 37/096; F16L 37/18; F16L 37/20

USPC ..... 137/377, 312; 285/8, 312, 87, 88, 373, 285/419

See application file for complete search history.

(56) References Cited

U.S. PATENT DOCUMENTS

| | | | | | |
|---|---|---|---|---|---|
| 613,263 | A * | 11/1898 | Gilmour | C02F 1/42 | 137/544 |
| 1,040,039 | A * | 10/1912 | Shapro | F16L 37/48 | 285/12 |
| 1,187,553 | A * | 6/1916 | Riordan | F16L 37/252 | 285/313 |
| 1,253,309 | A * | 1/1918 | Ulleland | F16L 37/48 | 285/108 |
| 1,342,000 | A * | 6/1920 | Schamberg | F16L 37/20 | 285/311 |

(Continued)

FOREIGN PATENT DOCUMENTS

| | | | | |
|---|---|---|---|---|
| JP | 4463219 B2 * | 5/2010 | ..... | F16L 37/18 |

*Primary Examiner* — David E Bochna
(74) *Attorney, Agent, or Firm* — Schmeiser, Olsen & Watts LLP

(57) ABSTRACT

A containment apparatus includes a clamp having an axially extending passage and a containment assembly having an engagement element and a flexible elongated hose connected to the engagement element. A method of removing a fire sprinkler head from a pipe entails installing the clamp onto the pipe such that an end of said pipe and the sprinkler head extend from the clamp, and attaching the engagement element to the clamp so that the sprinkler head and the pipe end reside in the interior of the hose. The method further entails grasping the sprinkler head through the hose without breaching the sidewall of the hose, detaching the sprinkler head from the pipe, and releasing the sprinkler head to allow the sprinkler head and any residual water in the pipe to fall into and be contained by a lower portion of the hose.

15 Claims, 10 Drawing Sheets

(56) References Cited

U.S. PATENT DOCUMENTS 5,344,193 A * 9/1994 Rio ..... F16L 35/00 137/312
5,725,009 A * 3/1998 Mallow, Sr. ..... F16L 55/18 137/15.09
5,752,540 A * 5/1998 Hansel, Sr. ..... A62C 35/68 137/15.16
5,911,445 A * 6/1999 Lee ..... F16L 37/18 285/312
5,944,362 A * 8/1999 Harle ..... F16L 25/0036 285/148.14
5,947,530 A * 9/1999 Harle ..... F16L 37/18 285/145.2
6,227,232 B1 * 5/2001 Williams, Sr. ..... A62C 35/68 137/312
6,487,942 B1 12/2002 Carter et al.
6,845,784 B2 1/2005 Pascznk
7,354,077 B1 * 4/2008 Jumonville ..... F16L 37/18 285/312
8,827,320 B2 * 9/2014 Topacio ..... F16L 37/0847 285/1
2006/0157112 A1 * 7/2006 Brewer ..... B08B 17/00 137/312
2012/0255629 A1 * 10/2012 Goss ..... A62C 35/68 137/377
2014/0284921 A1 * 9/2014 van der Valk ..... F16L 37/248 285/312

* cited by examiner

CONTAINMENT APPARATUS AND METHOD OF REMOVING A FIRE SPRINKLER HEAD

TECHNICAL FIELD OF THE INVENTION

The present invention relates generally to hand held tools. More specifically, the present invention relates to a containment apparatus and method for containing water when removing fire sprinkler heads.

BACKGROUND OF THE INVENTION

A fire sprinkler system is an active fire protection measure which includes a water supply system that provides adequate pressure and flow rate to a water distribution pipe system. Fire sprinkler heads are connected to the water distribution pipe system. In general, each sprinkler head system is held closed until the ambient temperature around the sprinkler head reaches the design activation temperature of the individual sprinkler head. The sprinkler head is activated to release water when the predetermined heat level is reached in order to extinguish or at least suppress a fire. Fire sprinkler systems are used extensively worldwide in large commercial buildings, as well as in small buildings and in homes.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, the Figures are not necessarily drawn to scale, and:

DETAILED DESCRIPTION

Figure 1:
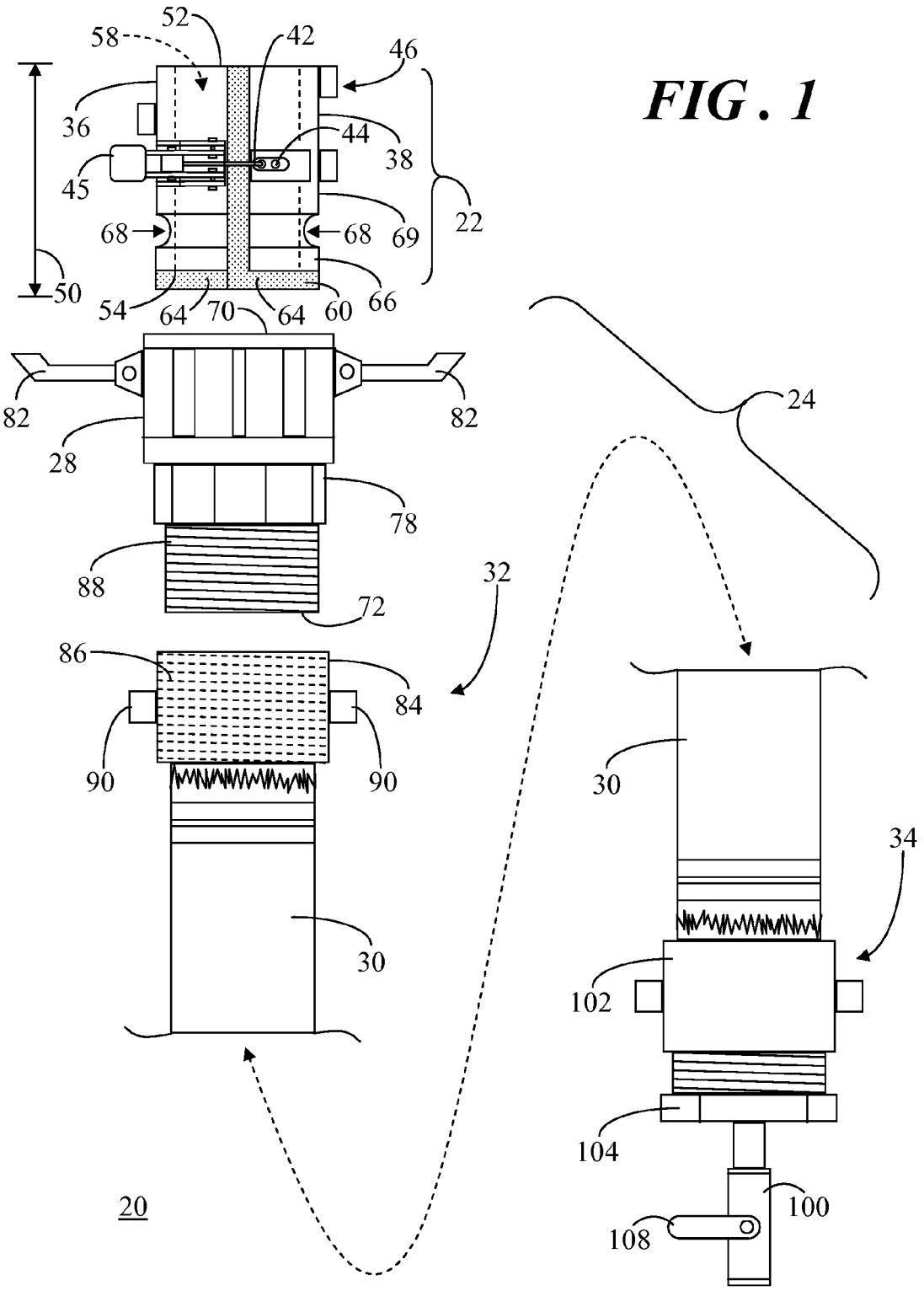
FIG. 1 shows an exploded side view of an apparatus in accordance with an embodiment.

The failure of a ceiling mounted fire sprinkler head, whether through product failure or through accidental damage, necessitates the removal of the sprinkler head from the system and the installation of an undamaged replacement part. Additionally, there have been recalls of some fire sprinkler head models due to product failures and/or potential product failures also necessitating removal of the sprinkler heads from the system.

One of the problems faced by a service technician when replacing fire sprinkler heads in an occupied building is that trapped water remains in the water distribution pipe system after the main water supply system as been shut off and the system drains are opened. The residual water may be trapped in the piping for a number of reasons. For example, the piping may have improper pitch, so that water does not effectively flow to the system drains. In addition or alternatively, the piping "drops" that extend downward from the piping branch lines or mains to the ceiling level may also contain trapped water. It is difficult if not impossible to the amount of residual water that may or may not be trapped in a system that has already been drained.

Due to the potential for trapped water, it is typically necessary to relocate equipment and personnel from the immediate area and to cover the floor and possibly the walls with plastic sheeting to prevent any residual water that may leak from the piping as the fire sprinkler head is being removed in order to limit damage to the surrounding environment. Furthermore, the residual water contained in fire sprinkler systems is typically contaminated from the oil used in cutting the pipe and the residual water has a distinct foul odor. The oil contamination and the foul odor can exacerbate damage to the surrounding environment if any of the residual water leaks or sprays from the piping as the fire sprinkler head is being removed. Accordingly, two technicians are typically present when removing fire sprinkler heads so that one technician can contain the leaking water in a bucket as the other technician removes the sprinkler head. Of course, potential still exists for damaging the surrounding environment due to spraying water or water overflowing the bucket. Furthermore, a technique that calls for two technicians can be undesirably expensive in terms of labor costs and schedule management.

Embodiments entail a containment apparatus and a method of removing a fire sprinkler head using the containment apparatus. The apparatus and methodology enable a single field service technician to remove a fire sprinkler head from an existing sprinkler system in an occupied building, and effectively control the flow of residual water that may be present in the piping even after the system is drained for service. The apparatus effectively contains splash and/or water drainage from the pipe as the sprinkler head is being removed. Thus, the technician need not move or cover sensitive equipment, furniture, and personnel from the immediate area. Since any residual water is contained, the potential for staining and water damage caused by an uncontrolled draining or spraying of the residual water is largely eliminated. The method can be implemented by a single technician using the containment apparatus, thereby significantly reducing labor costs. Furthermore, the containment apparatus can effectively contain water flowing at standard water flowrates in the event that the technician failed to turn off the water supply, drained the wrong piping system, or otherwise failed to drain the system in preparation for changing a fire sprinkler head.

FIG. 1 shows an exploded side view of an apparatus 20 in accordance with an embodiment. Apparatus 20 is adapted to contain, or retain, residual water that may be in a pipe as a fire sprinkler head is being removed from the pipe. Additionally, apparatus 20 is adapted to contain, or hold, the fire sprinkler head when it is first removed from the pipe. Accordingly, apparatus 20 is referred to hereinafter as containment apparatus 20.

In general, containment apparatus 20 includes a clamp 22 and a containment assembly 24. Clamp 22 is configured to be clamped around a pipe 26 (see FIG. 9), and containment assembly 24 is configured to be attached to clamp 22. Containment assembly 24 includes an engagement element 28 and a flexible elongated hose 30 having a first hose end 32 that is connectable to engagement element 28. Hose 30 further includes a second hose end 34 at an opposing end of hose 30. As shown in FIG. 1, hose 30 is not shown in its entirety due to its length. Rather, a curved, dashed line represents the interconnection of first and second hose ends 32 and 34, and the flexibility of the intervening hose material interconnecting first and second hose ends 32 and 34.

Figure 2:
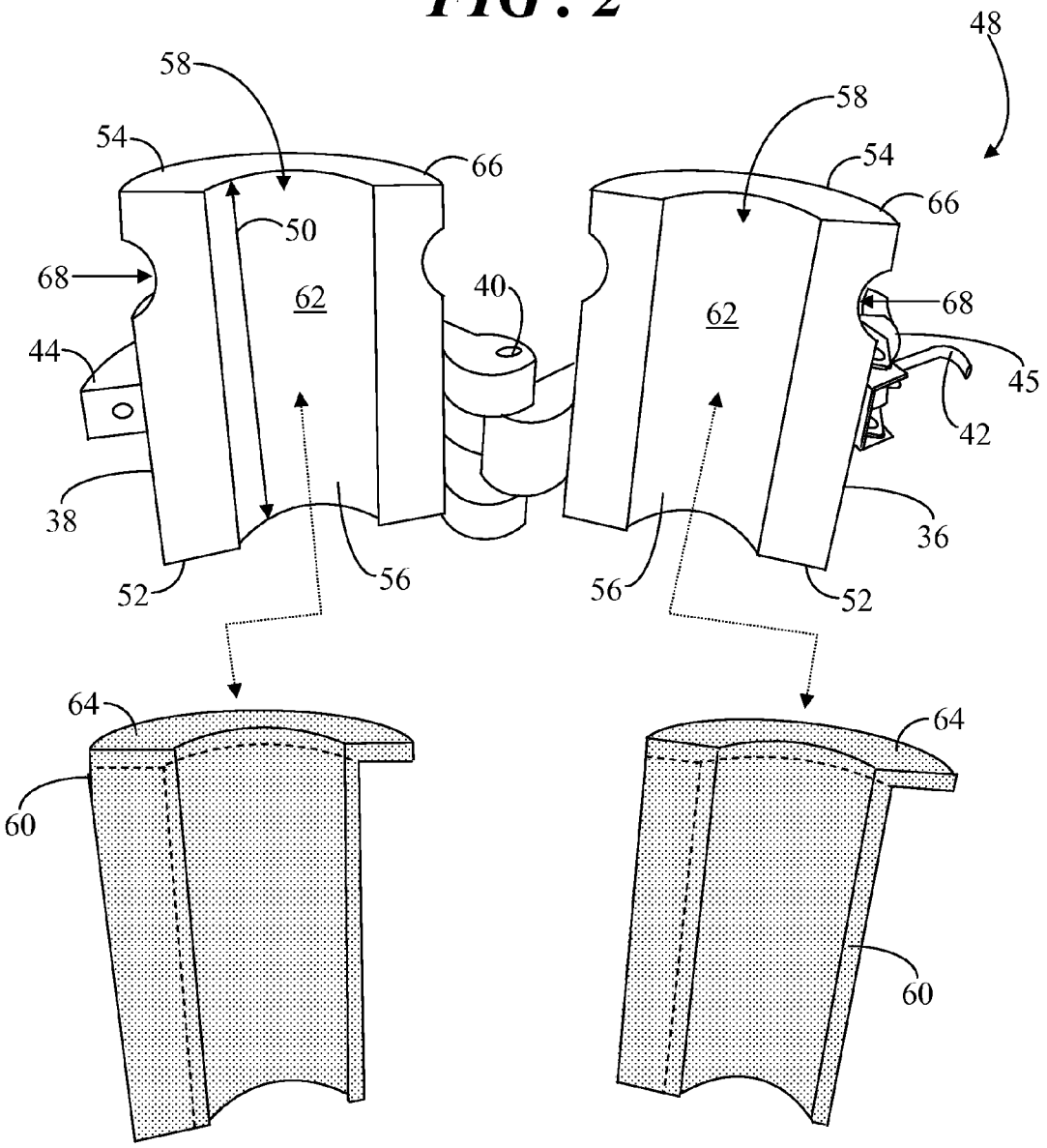
FIG. 2 shows a perspective view of a clamp of the apparatus of FIG. 1 in an open position.

Referring to FIG. 2 in connection with FIG. 1, FIG. 2 shows a perspective view of clamp 22 of containment apparatus 20. Clamp 22 is split longitudinally into a first portion 36, a second portion 38. At least one securing member is used to secure first and second portions 36 and 38 together. In an embodiment, clamp 22 includes securing members in the form of a hinge 40 and a fastener 42. First and second portions 36 and 38 are pivotally coupled to one another via hinge 40 so that first and second portions 36 and 38 cooperate to open and close. Fastener 42 on first portion 36 can then be secured via a latch mechanism 45 to a receptacle 44 in second portion 38 to secure first and second portions 36 and 38, respectively, in a clamped or closed arrangement. A closed configuration 46 of first and second portions 36 and 38 is demonstrated in FIG. 1, and an open configuration 48 of first and second portions 36 and 38 is demonstrated in FIG. 2. In the illustrated embodiment, hinge 40 and fastener 42 are utilized as securing members. However, alternative embodiments may include various fasteners, straps encircling first and second portions 36 and 38, or any of a variety of mechanisms for securing first and second portions 36 and 38 together in closed configuration 46.

Figure 9:
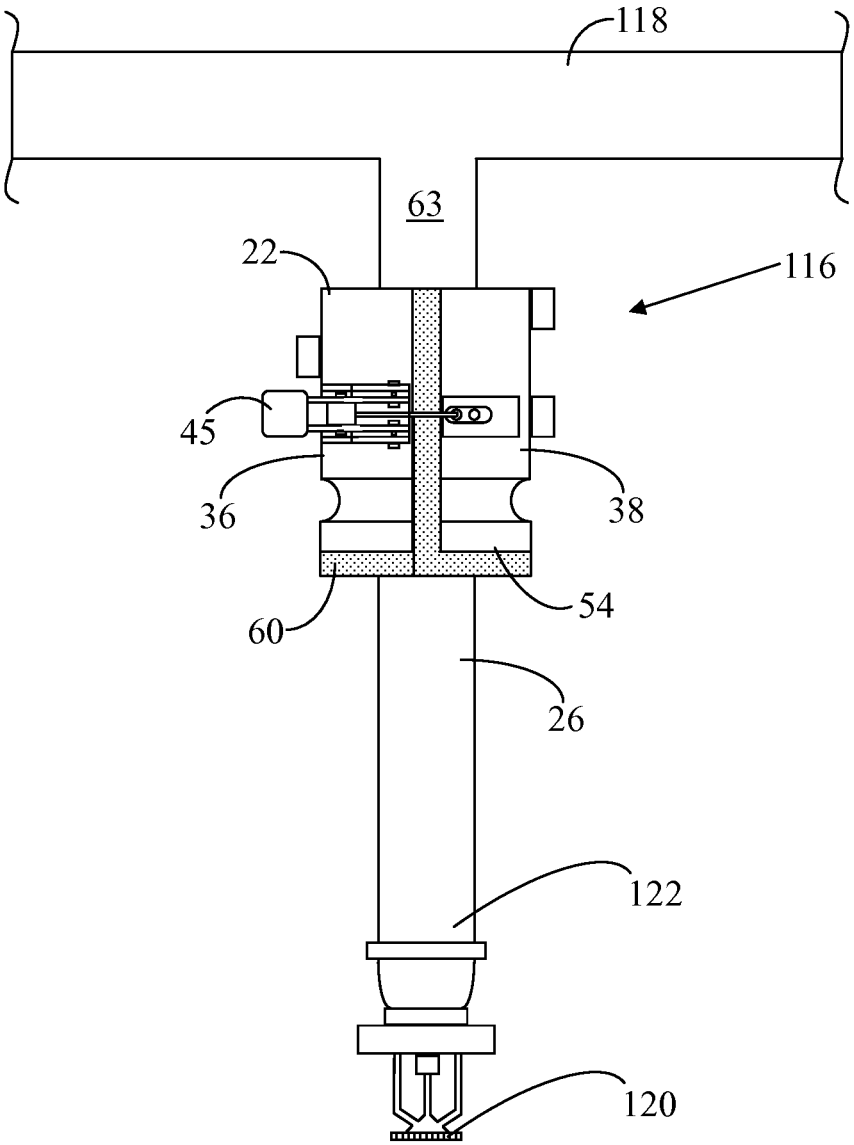
FIG. 9 shows a side view of the clamp in a clamped arrangement encircling a pipe.

Clamp 22 has a longitudinal dimension 50 defined by a first end 52 and a second end 54. Each of first and second portions 36 and 38 includes an outwardly curved section 56 radially, i.e., perpendicular to, longitudinal dimension 50. Thus, when clamp 22 is in closed configuration 46, an axially aligned passage 58 extends between first and second ends 52 and 54, respectively. For clarity, first end 52 will be referred to hereinafter as top end 52 and second end 54 will be referred to hereinafter as bottom end 54 due to their intended orientation on pipe 26 (FIG. 9). Clamp 22 may be a generally cylindrical structure with passage 58 extending through it. In alternative embodiments, an outside surface of clamp 22 may be a different shape with a suitable size and shape of axially aligned passage 58.

Clamp 22 further includes a seal material 60 lining an inside surface 62 of first and second portions 36 and 38, respectively. Seal material 60 may be a resilient rubber or silicon-based gasket material that may serve as a slip resistant liner, as well as a moisture tight seal, between an outer surface 64 (see FIG. 8) of pipe 26 (FIG. 9) and inside surface 62 of clamp 22. In an embodiment, seal material 60 may be formed as two distinct elements, each of which fits in its respective one of first and second portions 36 and 38. Seal material 60 may include a collar region 64 that extends outside of passage 58 and lies against an outside flange section 66 of clamp 22 at bottom end 52 in order to produce a moisture tight seal between clamp 22 and engagement element 28 (discussed below).

In FIG. 2, seal material 60 is separated away from first and second portions 36 and 38 for illustrative purposes. In FIG. 1, seal material 60 is located in passage 58, as well as between the longitudinal edges of first and second portions 36 and 38. Seal material 60 may be glued or otherwise secured to first and second portions 36 and 38, respectively. Accordingly, when fastener 42 is secured in receptacle 44, latch mechanism 45 pulls first and second portions 36 and 38 together with enough pressure to generate the moisture tight seal.

Clamp 22 further includes a groove region 68 formed at bottom end 54. Groove region 68 is an indented area formed in each of first and second portions 36 and 38 to produce a continuous groove encircling an outer periphery 69 of clamp 22 when clamp 22 is in closed configuration 46. As will be discussed in greater detail below, projection members in engagement element 28 engage with groove region 68 and are held in locked engagement to attach engagement element 28 with clamp 22.

Figure 3:
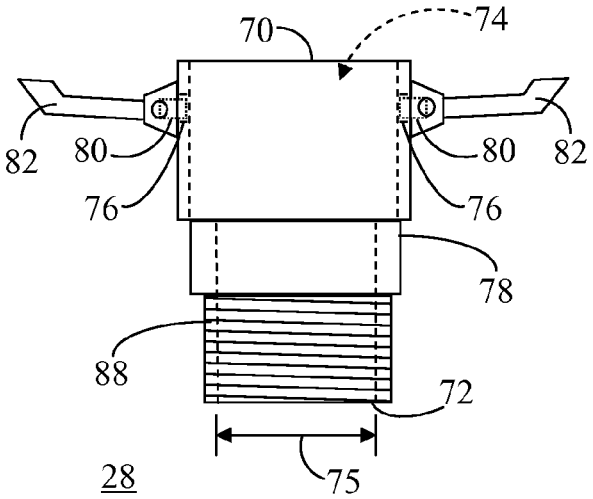
FIG. 3 shows a side view of an engagement element of a containment assembly of the apparatus of FIG. 1.
Figure 4:
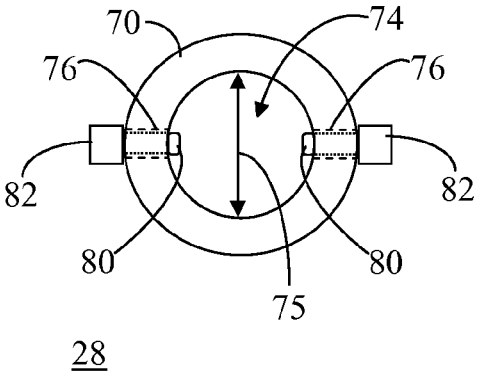
FIG. 4 shows a top view of the engagement element.

Now referring to FIGS. 3 and 4 in connection with FIG. 1, FIG. 3 shows a side view of engagement element 28 of containment assembly 20, and FIG. 4 shows a top view of element 28. Engagement element 28 has a first open end 70 for receiving bottom end 54 (FIG. 1) of clamp 22 (FIG. 1), a second open end 72, and a passage 74 extending between first and second open ends 70 and 72 of engagement element 28, where passage 74 is characterized by an inner diameter 75. In addition, engagement element 28 includes at least one aperture 76 extending through a wall portion 78 of engagement element 28. A projection member 80 is configured to extend through each aperture 76. Containment assembly 24 further includes an actuator 82 in mechanical communication with each projection member 80 for forcing projection member 80 through aperture 76 and into passage 74 of engagement element 28 (best seen in FIG. 4).

Figure 5:
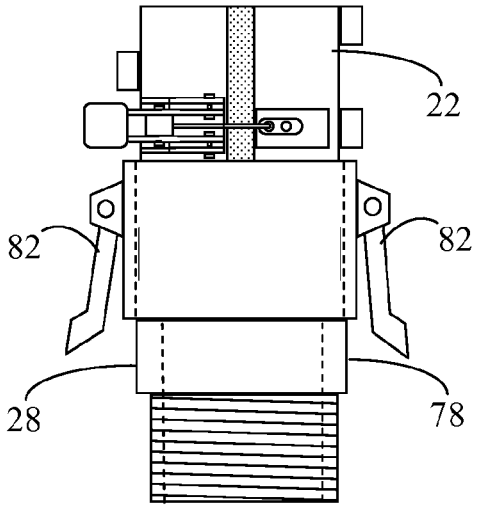
FIG. 5 shows a side view of the engagement element attached to an end of the clamp.

Referring to FIGS. 3-5, FIG. 5 shows a side view of the engagement element 28 attached to bottom end 54 of clamp 22. Actuator(s) 82 and projection member(s) 80 may form part of a cam lock fitting, also referred to as a cam and groove coupling, or simply a cam lock. Cam lock fittings generally function by having a pair of cams which rotate upon a fixed axis such that upon rotation from an unlocked position to a locked position, the distended portion of each cam extends through openings in the sidewall of a first fitting. When the first fitting is mated with a corresponding second fitting, rotation of the cams to the locked position causes the distended portion of the cams to wedge against grooves in the sidewall of the second fitting to reversibly lock together the two fittings. In an embodiment, projection member(s) 80 are the cams which can be moved from an unlocked position to a locked position via actuators 82. When moved to the locked position, projection member(s) 80 extend through apertures 76 in wall portion 78 of engagement element 28 to wedge against groove region 68 (FIG. 1) of clamp 22 in order to secure engagement element 28 of containment assembly 24 to clamp 22.

Figures 6, 7:
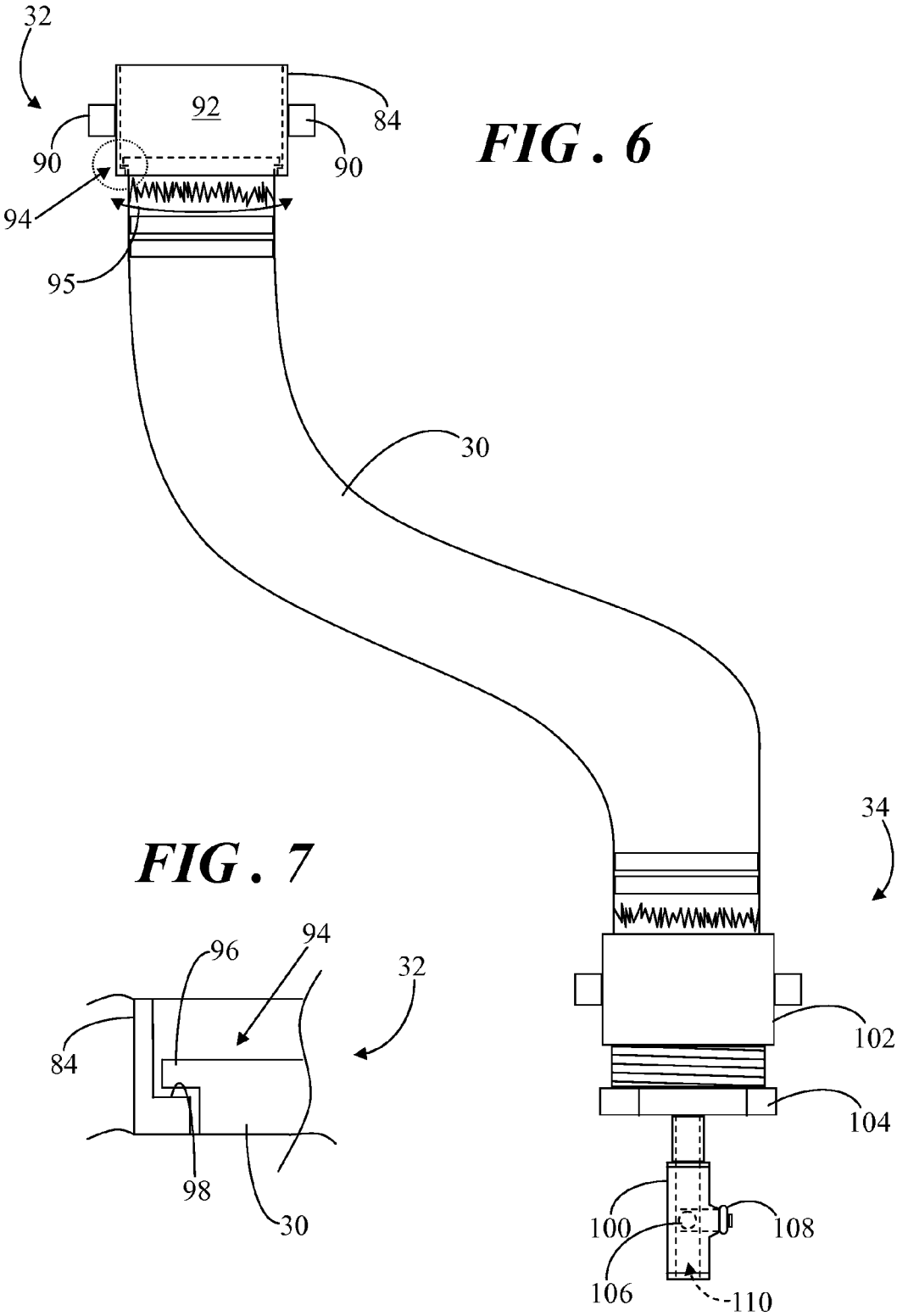
FIG. 6 shows a side view of a flexible elongated hose of the containment assembly.
FIG. 7 shows a enlarged partial view of the flexible elongated hose.

Referring now to FIGS. 6 and 7 in connection with FIG. 1, FIG. 6 shows a side view of flexible elongated hose 30 of containment assembly 24 and FIG. 7 shows a enlarged partial view of flexible elongated hose 30. Elongated hose 30 includes a collar region 84 at first hose end 32. Collar region 84 includes interior threads 86, represented by angled dashed lines in FIG. 1, that are configured to engage with exterior threads 88 of engagement element 28. Collar region 84 further includes protrusions 90 extending outwardly from an outer surface 92 of collar region 84. Protrusions 90 may be hand gripped by a user so that the user can turn collar region and engage interior threads 86 with exterior threads 88 of engagement element 28.

Flexible elongated hose 30 is movable relative to engagement element 28 via a swivel fitting 94 at first hose end 32. This swiveling movement is represented by a bi-directional arrow 95 Swivel fittings sometimes referred to as rotating swivel joints, rotary couples, rotary unions, and so forth are precision mechanical devices used to transfer fluid from a stationary source into a device capable of rotation relative to the stationary source. Rotating swivel joints are sometimes used with fire hoses to allow the hose to rotate while the end coupled to the water source is fixed. In a simplified exemplary embodiment, swivel fitting 94 may include an outwardly extending flange 96 that is configured to seat against an inwardly extending seat 98 of collar region 84. Flange 96 is sized to enable it to rotate or swivel relative to seat 98 in order to enable rotation of hose 30. Of course, those skilled in the art will recognize that there are a great variety of swivel fitting designs that can include, for example, a spring-loaded mechanical seal ring to prevent fluid leakage, an internal bushing, ball bearings, and so forth.

Flexible elongated hose 30 may be of any suitable length. In an embodiment, hose 30 may be fabricated out of a length of fire hose. A fire hose is a high-pressure hose typically used to carry water or other fire retardant to a fire to extinguish it. A typical working pressure of a fire hose can vary between 8 and 20 bar, while its bursting pressure can be up to 83 bar. Hose 30 may be formed from a synthetic fiber, such as polyester or nylon filament. A moisture barrier layer, such as a thin tube of extruded rubber or other elastomer, may line hose 30 to prevent water from seeping through hose 30.

Containment assembly 24 further includes a fluid valve 100 coupled to second hose end 34 of hose 30. In an embodiment, another collar region 102 may be coupled to second hose end 34. Collar region 102 may optionally include a swivel fitting (not shown), as discussed above. A removable cap 104 can be in threaded engagement with collar region 102 at second hose end 34, and fluid valve 100 may be coupled to removable cap 104. In FIGS. 1 and 6, fluid valve 100 is shown in its closed configuration such that water cannot drain from fluid valve 100. As particularly shown in FIG. 6, fluid valve 100 may include a port 106 that allows water to pass through valve 100 when a handle 108 of fluid valve 100 is moved to a suitable position so that port 106 aligns with an inner passage 110 of valve 100.

Figure 8:
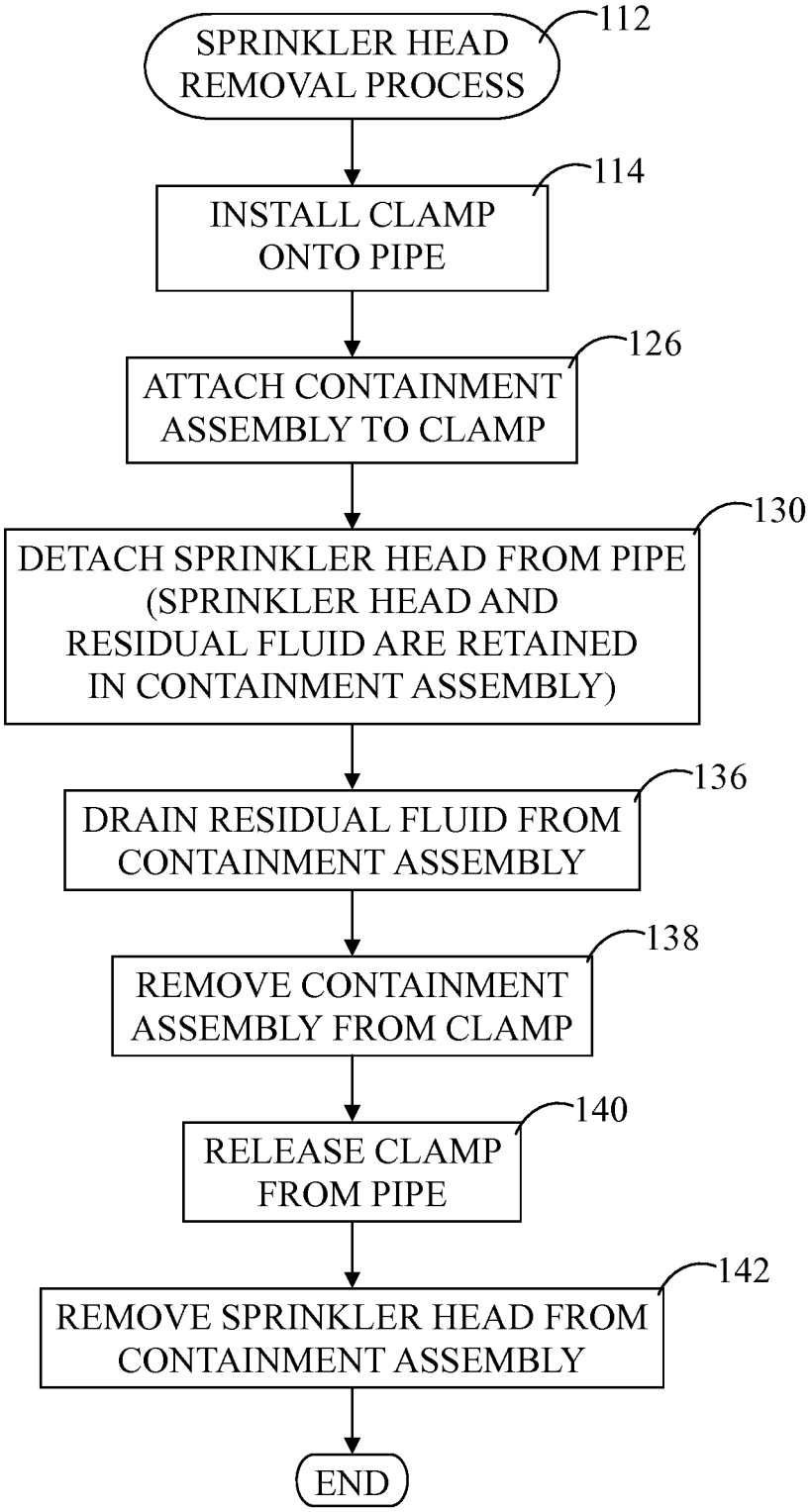
FIG. 8 shows a flow chart of a sprinkler head removal process in accordance with an embodiment.

Referring now to FIG. 8, FIG. 8 shows a flow chart of a sprinkler head removal process 112 in accordance with an embodiment. Sprinkler head removal process 112 is to remove a sprinkler head from pipe 26 (FIG. 9) using containment apparatus 20. Containment apparatus 20 effectively contains splash and/or water drainage from pipe 26 as the sprinkler head is being removed. Since any residual water is contained, the potential for staining and water damage caused by an uncontrolled draining or spraying of the residual water is largely eliminated. Additionally, containment apparatus 20 is operable by a single technician, thereby reducing labor costs relative to using two technicians to replace sprinkler heads.

Process 112 begins with a task 114. At task 114, clamp 22 is installed onto pipe 26. Referring to FIG. 9 in connection with task 114, FIG. 9 shows a side view of clamp 22 in a clamped arrangement 116 encircling pipe 26. As shown, pipe 26 is a "drop" that extends downward from a piping main 118. A sprinkler head 120 is attached to a pipe end 122 of pipe 26. Main 118 may have improper pitch, so that residual water does not effectively flow to the system drains. In addition or alternatively, pipe 26 extending downward from the main 118 may also contain trapped water. This residual water may leak from pipe end 122 of pipe 26 when sprinkler head 120 is removed from pipe end 122. As described previously, clamp 22 is split longitudinally into first and second portions 36 and 38 which are hinged to allow clamp 22 to open. Clamp 22 is placed on pipe 26 above sprinkler head 120 and is latched in place using latch mechanism 45. Thus, when clamp 22 is installed onto pipe 26, pipe end 122 and sprinkler head 120 extend from bottom end 54 of clamp 22. Latch mechanism 45 pulls first and second portions 36 and 38 together with enough pressure so that seal material 60 forms a moisture tight seal between outer surface 63 of pipe 26 and clamp 22.

Figure 10:
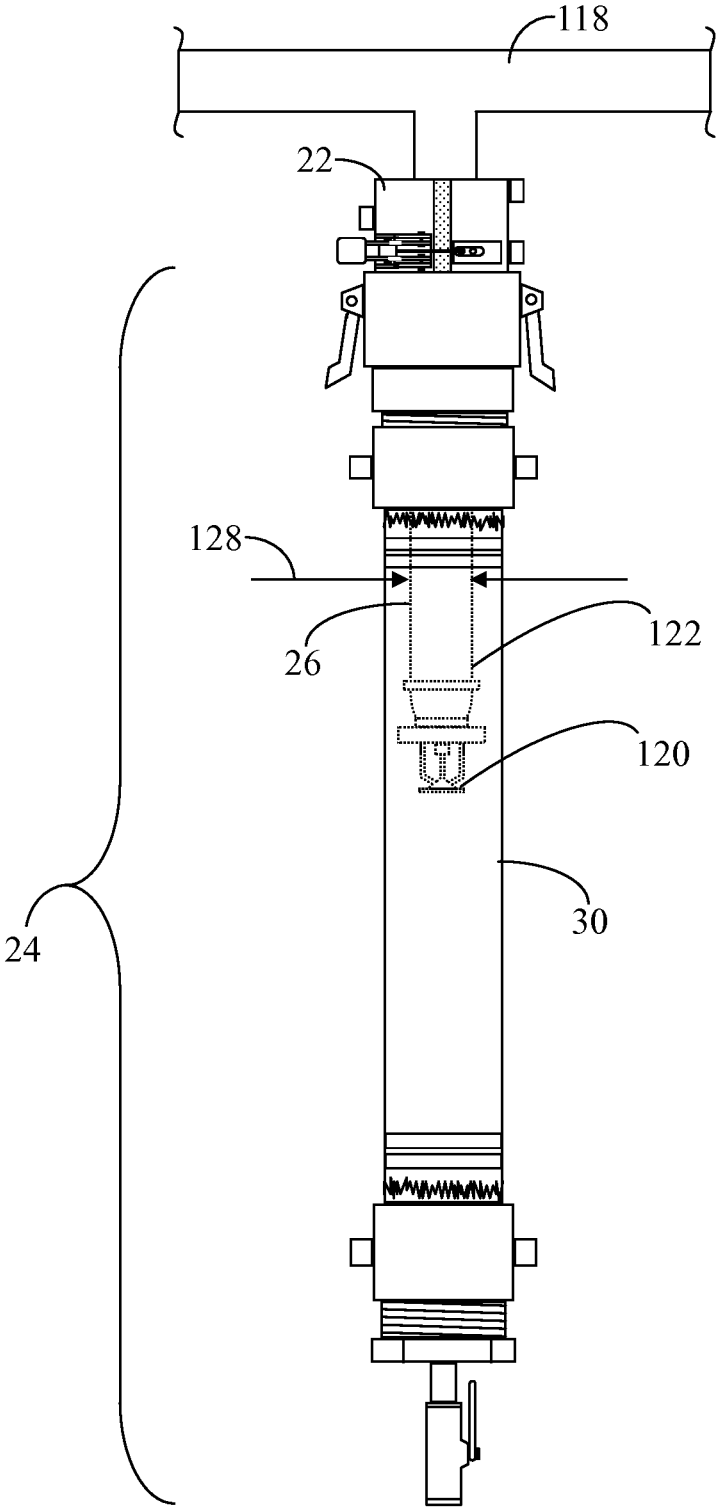
FIG. 10 shows a side view of the containment assembly attached to the clamp.

Referring back to FIG. 8, following task 114, sprinkler head removal process 112 continues with a task 126. At task 126, containment assembly 24 is attached to clamp 22. Referring to FIG. 10 in connection with task 126, FIG. 10 shows a side view of containment assembly 24 attached to clamp 22. In accordance with an embodiment, inner diameter 75 (FIG. 3) of passage 74 in engagement element 28 is greater than an outer diameter 128 of pipe 26 so that engagement element 128 can slide over sprinkler head 120 and pipe 26 and attach to bottom end 54 (FIG. 1) of clamp 22 with pipe end 122 and the attached sprinkler head 120 housed in flexible elongated hose 30. In particular, engagement element 28 is cam-locked onto clamp 22. The interior mating surface of engagement element 128 is seated against clamp 22 and is actuated so that projection members 80 (FIG. 4) are engaged with groove region 68 (FIG. 1). attachment provides the water tight seal for containment assembly 24. A portion of pipe 26, pipe end 122, and sprinkler head 120 are shown in dotted line form to illustrate their location as residing in an interior volume of hose 30 of containment assembly 24.

Figure 11:
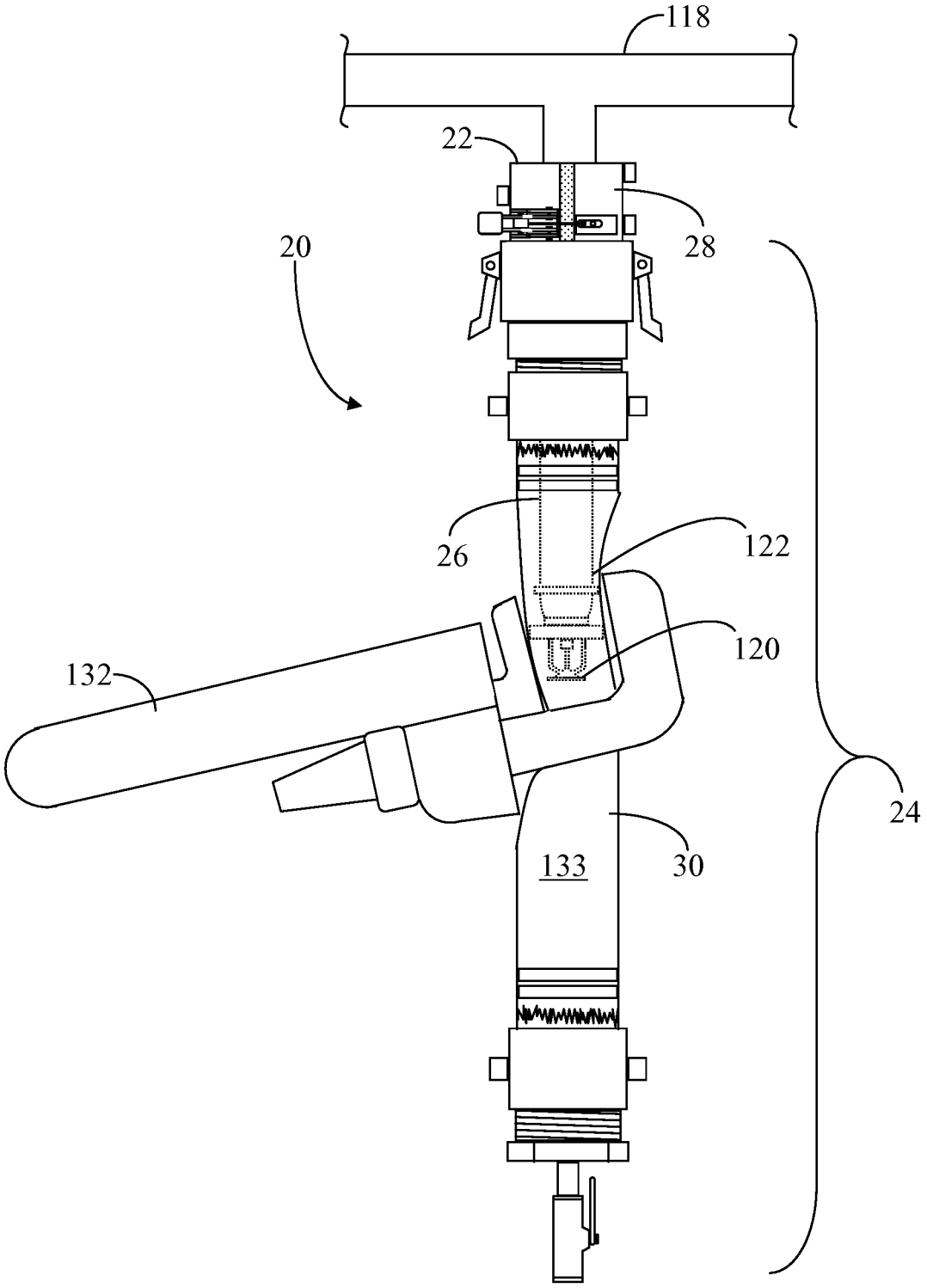
FIG. 11 shows a side view of the apparatus being used to facilitate removal of a fire sprinkler head.

With continued reference to FIG. 8, following the attachment of containment assembly 24 to clamp 22 at task 126, sprinkler head removal process 112 continues with a task 130. At task 130, sprinkler head 120 is detached from pipe 26. Referring to FIG. 11 in connection with task 130, FIG. 11 shows a side view of containment apparatus 20 being used to facilitate removal of fire sprinkler head 120. In particular, a tool 132 may be used to grasp fire sprinkler head 120 through a sidewall 133 of hose 30, and twisting until sprinkler head 120 falls free from pipe end 122. Although tool 132 is represented by a pipe wrench, those skilled in the art will recognize that any of a variety of conventional and application specific tools may be used to grasp sprinkler head 120.

Figure 12:
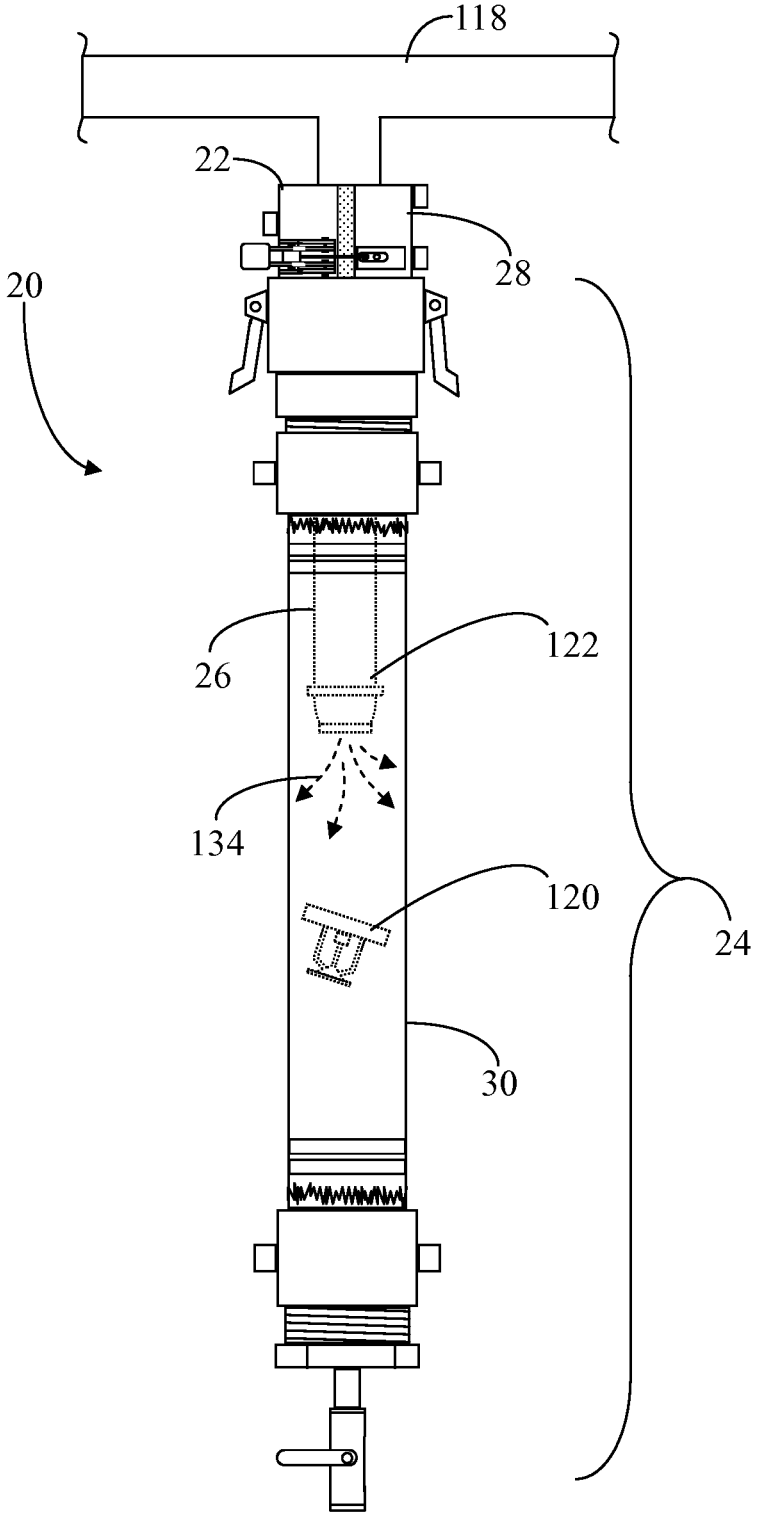
FIG. 12 shows a side view of the apparatus with the fire sprinkler head dropping into the containment assembly and water spraying from the end of the pipe.

FIG. 12 shows a side view of the apparatus with fire sprinkler head 120 dropping into containment assembly 24 and water 134 (represented by dashed lines) spraying from pipe end 122 of pipe 26. During the removal of sprinkler head 120 from pipe 26, any residual water 134 remaining in pipe 26 or main 118 may spray or otherwise drain from pipe end 122. Advantageously, sidewall 132 is not breached, or otherwise broken, ruptured, or torn when grasping sprinkler head 120 with tool 132 (FIG. 11) due to the flexibility and durability of hose 30, as well as due to the ability of hose 30 to swivel relative to engagement element 28 via swivel fitting 94 (FIG. 7). Therefore, residual water 134, including any contaminants in water 134, will be retained in containment assembly 24. Additionally, the high-pressure capability of hose 30 prevents water leakage from containment apparatus 20 at standard flowrates in the event that the technician failed to turn off the water supply, drained the wrong piping, or otherwise failed to remove the water pressure in the system in preparation for changing fire sprinkler head 120.

Figure 13:
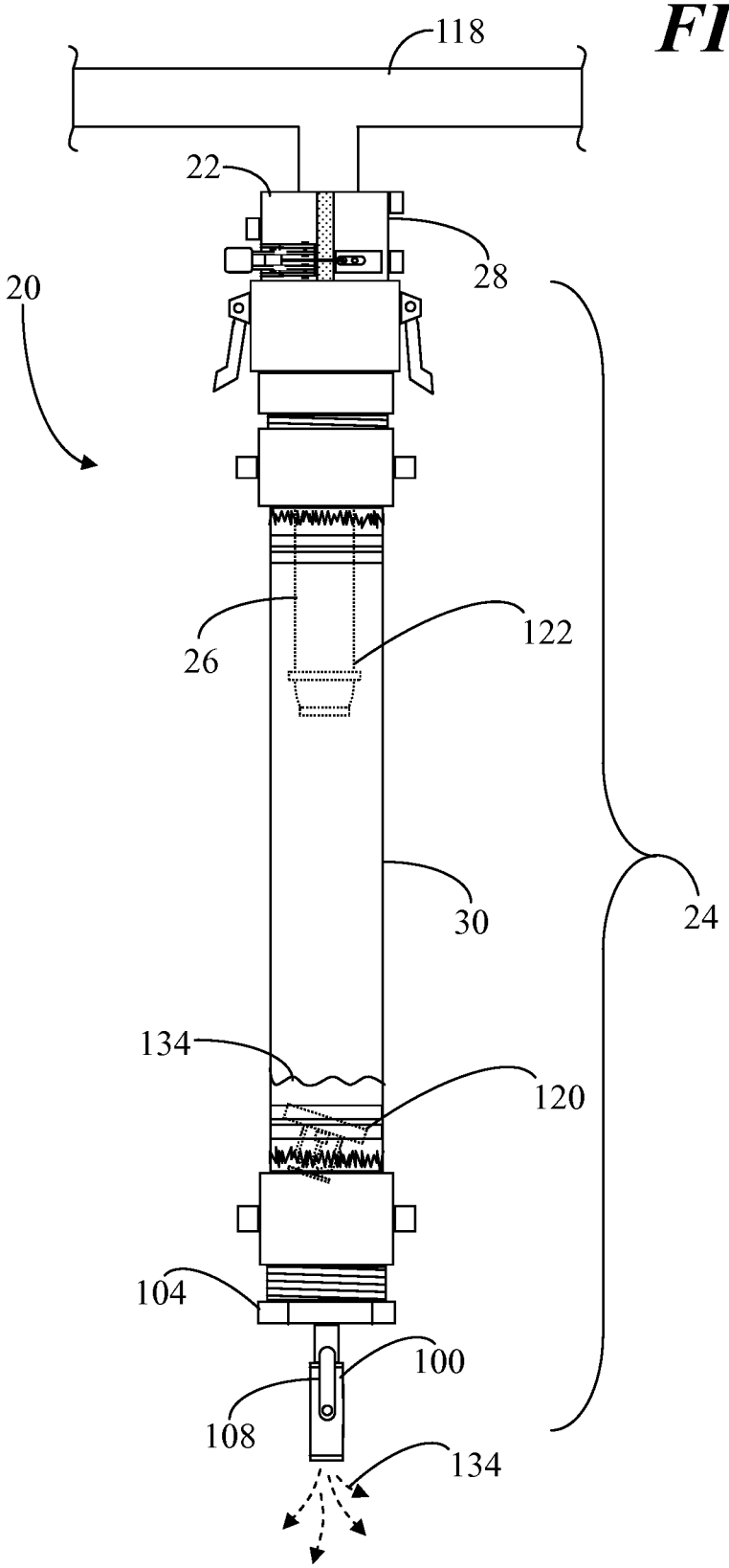
FIG. 13 shows a side view of the containment apparatus from which water is being drained.

Referring back to FIG. 8, following task 130, sprinkler head removal process 112 continues with a task 136. At task 136, any residual fluid in pipe 26 and main 118 can be drained from containment assembly 22 of apparatus 20. Referring to FIG. 13 in connection with task 136, FIG. 13 shows a side view of containment apparatus 20 from which water 134 is being drained. As shown, sprinkler head 120 has dropped into a lower portion, i.e., the bottom, of hose 30 of containment assembly 24. Additionally, residual water 134 has pooled up in the bottom of hose 30 containment assembly 24. Handle 108 of fluid valve 100 has been turned approximately ninety degrees to open valve 100. Thus, water 134 is allowed to drain from containment apparatus 20 via the open fluid valve 100. Fluid valve 100 allows a controlled release of water 134 that may subsequently be captured in a bucket, another container, or directed into a building drain.

With reference back to FIG. 8, following task 136 in which water 134 is drained from containment assembly 24, process 112 continues with a task 138. At task 138, containment assembly 24 is released from clamp 22 in a reverse operation from attachment task 126.

Next, a task 140 is performed. At task 140, clamp 22 is released from pipe 26 in a reverse operation from installation task 114. Sprinkler head removal process continues with a task 142. At task 142, fire sprinkler head 120 (FIG. 9) is removed from containment assembly 24 (FIG. 1). For example, cap 104 (FIG. 1) may be detached from collar region 102 (FIG. 1) so that sprinkler head 120 drops from second hose end 34 (FIG. 1) of hose 30 of containment assembly 24. Alternatively, containment assembly 24 may be turned upside down so that sprinkler head 120 drops from first hose end 32 (FIG. 1) of hose 30. Following task 140, sprinkler head removal process 112 ends. However, process 112 may be repeated for each fire sprinkler head 120 that is to be removed.

Embodiments described herein comprise a containment apparatus and a method of removing a fire sprinkler head using the containment apparatus. The apparatus and methodology enable a single field service technician to remove a fire sprinkler head from an existing sprinkler system in an occupied building, and effectively control the flow of residual water that may be present in the piping even after the system is drained for service. The apparatus effectively contains splash and/or water drainage from the pipe as the sprinkler head is being removed. Thus, the technician need not move or cover sensitive equipment, furniture, and personnel from the immediate area. Since any residual water is contained, the potential for staining and water damage caused by an uncontrolled draining or spraying of the residual water is largely eliminated. The method can be implemented by a single technician using the containment apparatus, thereby significantly reducing labor costs. Furthermore, the containment apparatus can effectively contain water flowing at standard water flowrates in the event that the technician failed to turn off the water supply, drained the wrong piping system, or otherwise failed to drain the system in preparation for changing a fire sprinkler head.

Although preferred embodiments of the invention have been illustrated and described in detail, it will be readily apparent to those skilled in the art that various modifications may be made therein without departing from the spirit of the invention or from the scope of the appended claims. For example, the cam lock fitting, valve, swivel fitting, seal material, and so forth can vary in structure from that which is shown. Further, the phraseology or terminology employed herein is for the purpose of description and not of limitation. Accordingly, while the principles of the inventive subject matter have been described above in connection with a specific apparatus and method, it is to be clearly understood that this description is made only by way of example and not as a limitation on the scope of the inventive subject matter.

The foregoing description of specific embodiments reveals the general nature of the inventive subject matter sufficiently so that others can, by applying current knowledge, readily modify and/or adapt it for various applications without departing from the general concept. Therefore, such adaptations and modifications are within the meaning and range of equivalents of the disclosed embodiments. The inventive subject matter embraces all such alternatives, modifications, equivalents, and variations as fall within the spirit and broad scope of the appended claims.

What is claimed is:

1. An apparatus comprising:

a clamp having a first portion and a second portion and at least one securing member for securing said first and second portions together to place said clamp in a closed configuration, said closed configuration of said clamp having an axially extending passage; and a containment assembly having an engagement element and a flexible elongated hose having a first hose end connected to said engagement element, said engagement element being selectively attachable to a first end of said clamp, wherein said clamp includes a groove region formed at a second end, said engagement element includes at least one projection member adapted to engage with said groove region to attach said engagement element with said clamp, and said groove region is formed in each of said first and second portions to produce a continuous groove encircling an outer periphery of said second end of said clamp when said clamp is in said closed configuration.

2. An apparatus as claimed in claim 1 wherein:

said first and second portions are adapted to cooperate with one another to close around and encircle a pipe; and said at least one securing member is adapted to secure said first and second portions in a clamped arrangement with said pipe residing in said passage.

3. An apparatus as claimed in claim 2 wherein said clamp is configured to be positioned in said clamped arrangement around said pipe with a pipe end of said pipe extending from said first end of said clamp, and said engagement element includes a central passage having an inner diameter that is greater than an outer diameter of said pipe end to enable said engagement element of said containment assembly to slide over said pipe end and attach to said first end of said clamp with said pipe end housed in said flexible elongated hose.

4. An apparatus as claimed in claim 1 wherein said clamp further comprises a seal material lining an inside surface of each of said first and second portions for providing a moisture tight seal between an outer surface of said pipe and said clamp.

5. An apparatus as claimed in claim 1 wherein:

said engagement element has an open end for receiving said first end of said clamp and at least one aperture extending through a wall portion of said engagement element, said at least one projection member being configured to extend through said at least one aperture; and said containment assembly further comprises an actuator in mechanical communication with said at least one projection member for forcing said at least one projection member through said at least one aperture and into said groove to hold said at least one projection member in locked engagement with said groove region.

6. An apparatus as claimed in claim 1 wherein:

said engagement element includes a first threaded portion; and said elongated hose includes a collar region at said first hose end, said collar region including a second threaded portion configured to engage with said first threaded portion.

7. An apparatus as claimed in claim 6 wherein said collar region includes protrusions extending outwardly from an outer surface of said collar region.

8. An apparatus as claimed in claim 1 wherein said flexible elongated hose includes a moisture barrier layer.

9. An apparatus as claimed in claim 1 wherein said flexible elongated hose is movable relative to said engagement element via a swivel fitting.

10. An apparatus as claimed in claim 1 wherein said containment assembly further includes a fluid valve coupled to a second hose end of said elongated hose.

11. An apparatus as claimed in claim 1 wherein said containment assembly further comprises a removable end cap coupled to a second hose end of said elongated hose.

12. An apparatus comprising:

a clamp having a first portion and a second portion and at least one securing member for securing said first and second portions together to place said clamp in a closed configuration, said closed configuration of said clamp having an axially extending passage defined by first and second ends, wherein a groove region is formed at said second end;

a containment assembly including:

an engagement element having at least one projection member adapted to engage with said groove region to attach said engagement element to said first end of said clamp; and a flexible elongated hose having a first hose end and a second hose end, said first hose end being connected to said engagement element; and capping means, coupled to said second hose end, for selectively enabling release of a material located in an interior of said hose.

13. An apparatus as claimed in claim 12 wherein:

said first and second portions are adapted to cooperate with one another to close around and encircle a pipe;

said at least one securing member is adapted to secure said first and second portions in a clamped arrangement with said pipe residing in said passage; and said clamp further comprises a seal material lining an inside surface of each of said first and second portions for providing a moisture tight seal between an outer surface of said pipe and said clamp.

14. An apparatus as claimed in claim 12 wherein said flexible elongated hose includes a moisture barrier layer.

15. An apparatus as claimed in claim 12 wherein said flexible elongated hose is movable relative to said engagement element via a swivel fitting.

* * * * *